United States Patent [19]

Limpaecher

[11] Patent Number: 4,755,719

[45] Date of Patent: Jul. 5, 1988

[54] SPARK GAP SWITCH WITH JET PUMP DRIVEN GAS FLOW

[75] Inventor: Rudolf Limpaecher, Topsfield, Mass.

[73] Assignee: Auco Research Laboratory, Inc., Everett, Mass.

[21] Appl. No.: 73,012

[22] Filed: Jul. 13, 1987

[51] Int. Cl.[4] ..... H01J 17/04

[52] U.S. Cl. ..... 313/597; 313/231.21; 313/231.31; 313/293; 313/325; 313/545; 313/595; 200/144 B; 200/148 R; 200/48 R; 200/148 E

[58] Field of Search ..... 315/111.01, 108, 109, 315/110; 313/581, 603, 602, 604, 143, 123, 231.11, 231.01, 7, 325, 611, 621, 545, 231.21, 231.31, 293; 200/144 B, 144 E, 148 R, 48 R; 361/120, 130

[56] References Cited

U.S. PATENT DOCUMENTS

| | | | |
|---|---|---|---|
| 3,207,947 | 9/1965 | Goncz | 315/109 |
| 3,418,507 | 12/1968 | Young | 313/231.71 |
| 3,447,013 | 5/1969 | Van Ornum et al. | 313/231.71 |
| 3,968,381 | 7/1976 | Gryzinski | 200/147 R |
| 4,027,187 | 5/1977 | Rabe | 313/231.01 |
| 4,237,404 | 12/1980 | Limpaecher | 315/111.01 |
| 4,360,763 | 11/1982 | Wickson | 315/111.01 |
| 4,507,589 | 3/1985 | Prono et al. | 315/111.01 |
| 4,563,608 | 1/1986 | Lawson et al. | 313/231.71 |

OTHER PUBLICATIONS

Ramrus, "Development of a 100 kV Multimegawatt Rep. Rate Gas Switch", Conf.: 1978 13th Pulse Power Modulator Symp., Buffalo, N.Y., Jun. 1978.

*Primary Examiner*—David K. Moore
*Assistant Examiner*—Mark R. Powell
*Attorney, Agent, or Firm*—M. E. Frederick

[57] ABSTRACT

A spark gap switch is disclosed with a pumping system which utilizes flowing gas to replenish the interelectrode region between conductive pulses. The spark gap switch typically consists of a housing enclosing a gas filled chamber in which there are two end electrodes with an intervening trigger plane electrode that may be inserted at other than midplane. To initiate switch closure, a trigger pulse is applied between one end electrode and a trigger plane electrode causing the gas in the intervening gap to ionize and conduct and thereby bring on complete switch closure. To achieve proper gas flow each end electrode is configured as a truncated cone and gas is caused to flow from a multiplicity of ports spaced equidistantly around each cone base. The gas ascends the conical outer surface of each end electrode, sweeps over the crown and exhausts out through an opening in the center of each electrode. From a small plenum in the base of each end electrode some of the gas is exhausted out of the system while the larger fraction is recirculated. Recirculation is accomplished by jet pumps using pressurized fresh gas streaming from nozzles within the base plate structure of each end electrode to draw exhaust gas into mixing chambers. The resulting mixture of new and exhaust gas flows out of the multiplicity of ports spaced equidistantly around the base of each end electrode. The flow rate is controlled so that the flush factors are the same on each end electrode.

7 Claims, 3 Drawing Sheets

FIG. 4
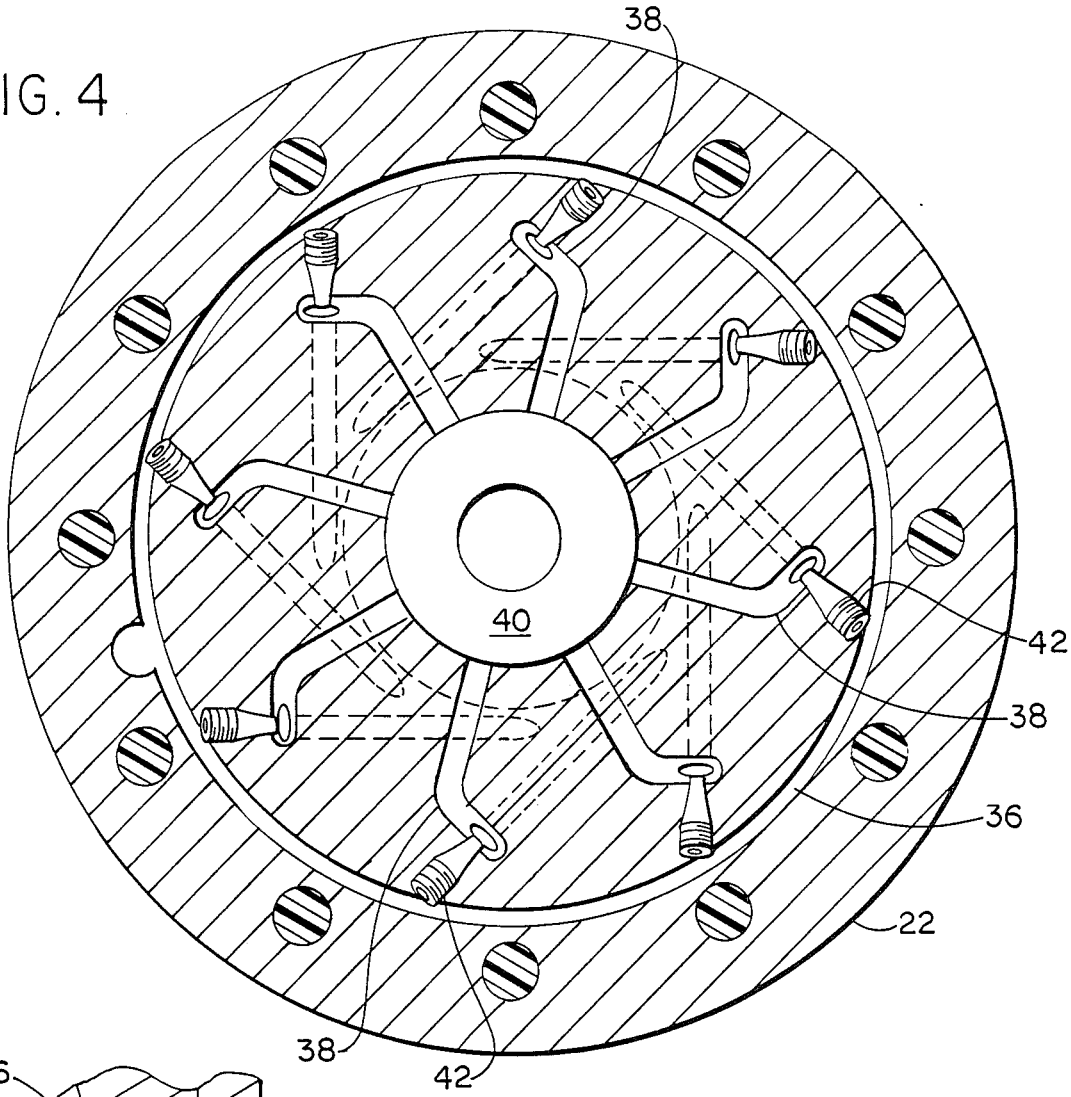
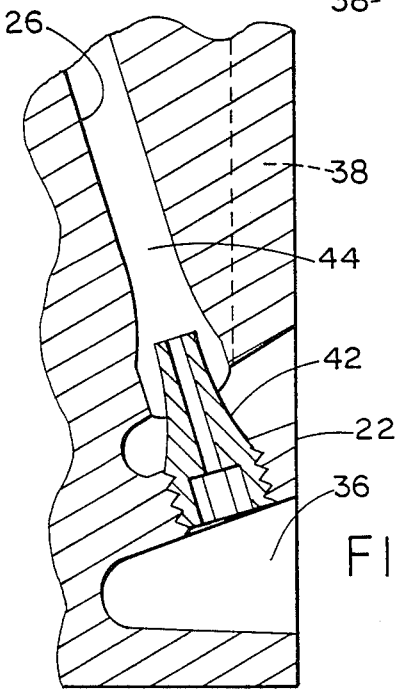
FIG. 5
FIG. 6
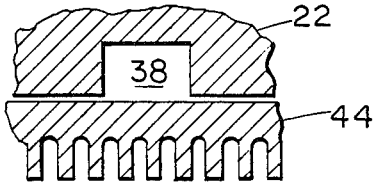

SPARK GAP SWITCH WITH JET PUMP DRIVEN GAS FLOW

BACKGROUND OF THE INVENTION

This invention relates generally to a spark gap switch allowing repetitive operation typically between 100 and 2000 pulses per second with voltages of several megavolts at power levels in the tens of megawatts.

In the prior art thyratrons were used to repetitively switch high voltages. However, as the voltage and power demands increased means other than thyratrons had to be found. The arc type switch of U.S. Pat. No. 3,968,381 to Wickson discloses spark gap technology for passing higher currents with higher rates of current increase than that possible with thyratrons. Wickson injects an auxiliary plasma between the main switch electrodes. Conduction is initiated through a plasma that is already in motion along the surfaces of the main electrodes thereby reducing conductor pitting and distributing localized heating to facilitate cooling of electrodes.

U.S. Pat. No. 4,360,763 to Gryzinski discloses another means for controlling great currents of the pulse type. Gas density variations between two electrodes are controlled by directing a gas stream into the region between the electrodes. Inside a vacuum chamber there are suitably arranged electrodes in the form of a cathode and an anode, a pulse gas source and an inductive winding.

U.S. Pat. No. 4,507,589 to Prono discloses spark gap apparatus for an electric switch operating at high voltage, high current and high repetition rate. Mounted inside a housing are an anode, cathode and ion plate. An ionizable fluid is pumped through the chamber of the housing. A pulse of current to the ion plate causes ions to be emitted by the ion plate, which ions move into and ionize the fluid. Electric current supplied to the anode discharges through the ionized fluid and flows to the cathode. Current stops flowing when the current source has been drained. The ionized fluid recombines into its initial dielectric ionizable state, opening the switch and readying it for another cycle.

None of these prior art disclosures have the voltage, current and power handling capabilities of my invention. Test results of my switch have thus far shown that there are no fundamental limits that would prohibit increasing the operating voltage, power and repetition rate.

SUMMARY OF THE INVENTION

This invention pertains to the pumping system for a spark gap switch which utilizes flowing gas to replenish the interelectrode region between conductive pulses. Generally, a spark gap switch in accordance with my invention combines within a single unit the capability to discharge a capacitor bank charged to 130 KV to 1500 KV with energy levels between 15 and 38 kilojoules. The switch further has the capability to work at rates of at least 100 pps with a lifetime expectancy of at least 100,000 pulses.

A spark gap switch having a gas pumping system in accordance with my invention consists of two end electrodes with an intervening common electrode that may be inserted at other than midplane. This can be looked upon as two spark gaps in series in a common envelope. The trigger is applied between one end electrode and the common electrode causing one side to exceed the self breakdown voltage level. As soon as the first side breaks down the second side is immediately overvolted and aided by ultraviolet illumination quickly breaks down developing a complete switch closure.

A typical switch discharge pulse may transfer a charge of several coulomb that has been stored in a capacitor bank, a pulse forming network or a pulse forming line. However, the resulting disturbance develops vaporized electrode material, solid particles and hot gas which must be cleared away in sufficient time to allow the device to hold off the next capacitor charge. If the clearing can be accomplished completely enough before the following charge voltage builds up then the complexity of a command charge system can be avoided and higher repetition rates can be obtained. The shape of the electrodes has a bearing on how fast the debris can be swept away. In my implementation each end electrode is configured as a truncated cone with an opening in the center. Gas is injected so that it flows outwardly from around the base of each electrode. Ihe gas ascends the conical outer surface of each end electrode, sweeps over the crown and exhausts out through the opening in the center. The flow rate is controlled so that the flush factors are the same on each of the end electrodes. Flush factors greater than 0.3 produce satisfactory results.

The switch configuration in accordance with the present invention began using an open loop gas flow. Thus, a fresh supply of gas was delivered under pressure to the base of each end electrode. The hot gas created at each conductive pulse was discharged through the center of each end electrode and then exhausted out of the system. I found that there was an optimum swirl flow pattern for the gas achievable by adjusting the ratio of tangential to radial gas flow across the outer surface of the spark gap electrodes. Spark gaps were operated with both air and $N_2$:$CO_2$:$H_2$ gas with practically no difference in performance. Gas flow requirements for an open loop system consume power to operate the compressor. For switches operating in the 130 KV to 1500 KV range with 100 pulses per second at upwards of 19 kilojoules per pulse I found that some 2 to 3 percent of the total prime power consumed was used to run the compressor supplying air to the open loop spark gap. For a gas other than air (for example, $N_2$:$CO_2$:$H_2$=3:1:0.08) costs are higher.

My invention lowers these costs by recycling a portion of the gas. Specifically, I utilize jet pumps to recirculate the switch gas several times through the electrode gap area. The jet pumps use a fresh supply of gas to draw exhaust gas back around the loop. There are no moving parts, no start up time is needed and no maintenance is required. Using the jet pump gas recirculation system reduces new gas flow requirements by a factor of 10 to 50.

BRIEF DESCRIPTION OF THE DRAWINGS

The accompanying drawings illustrate an embodiment of the invention and, together with the description, serve to explain the principles of the invention. In the drawings:

FIG. 4 is a cross sectional view taken along line 4—4 of FIG. 1 and showing the gas recirculation passageways formed in the electrode base.

FIG. 5 is an enlarged cross sectional view of one of the jet pumps used to recirculate hot gas.

FIG. 6 is an enlarged cross sectional view of one of the hot gas recirculation channels wherein cooling fins are added for heat extraction.

DETAILED DESCRIPTION OF THE PREFERRED EMBODIMENT

Figure 1:
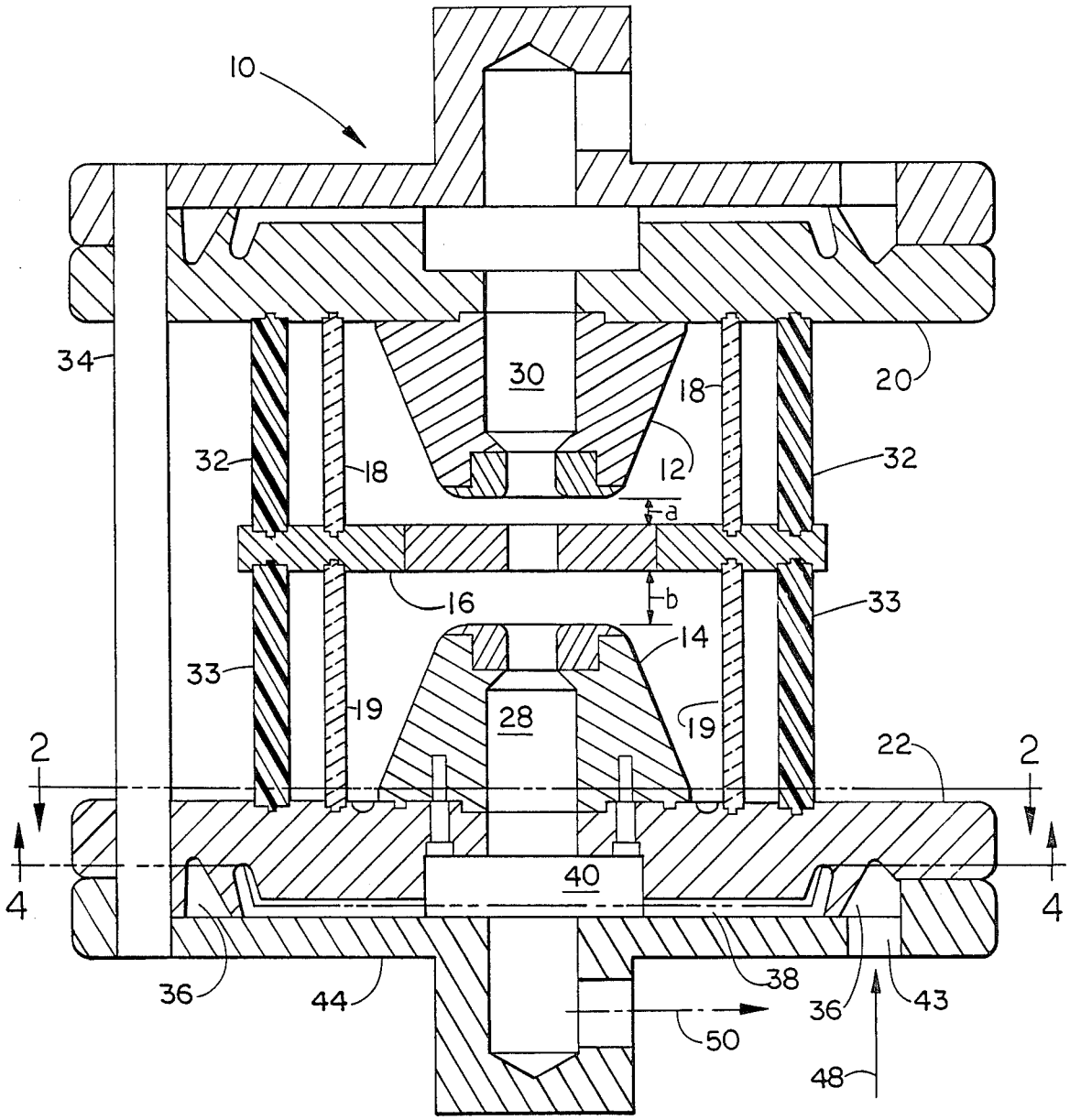
FIG. 1 is a side elevation cross sectional view of a two electrode spark gap switch having gas recirculation.
Figure 2:
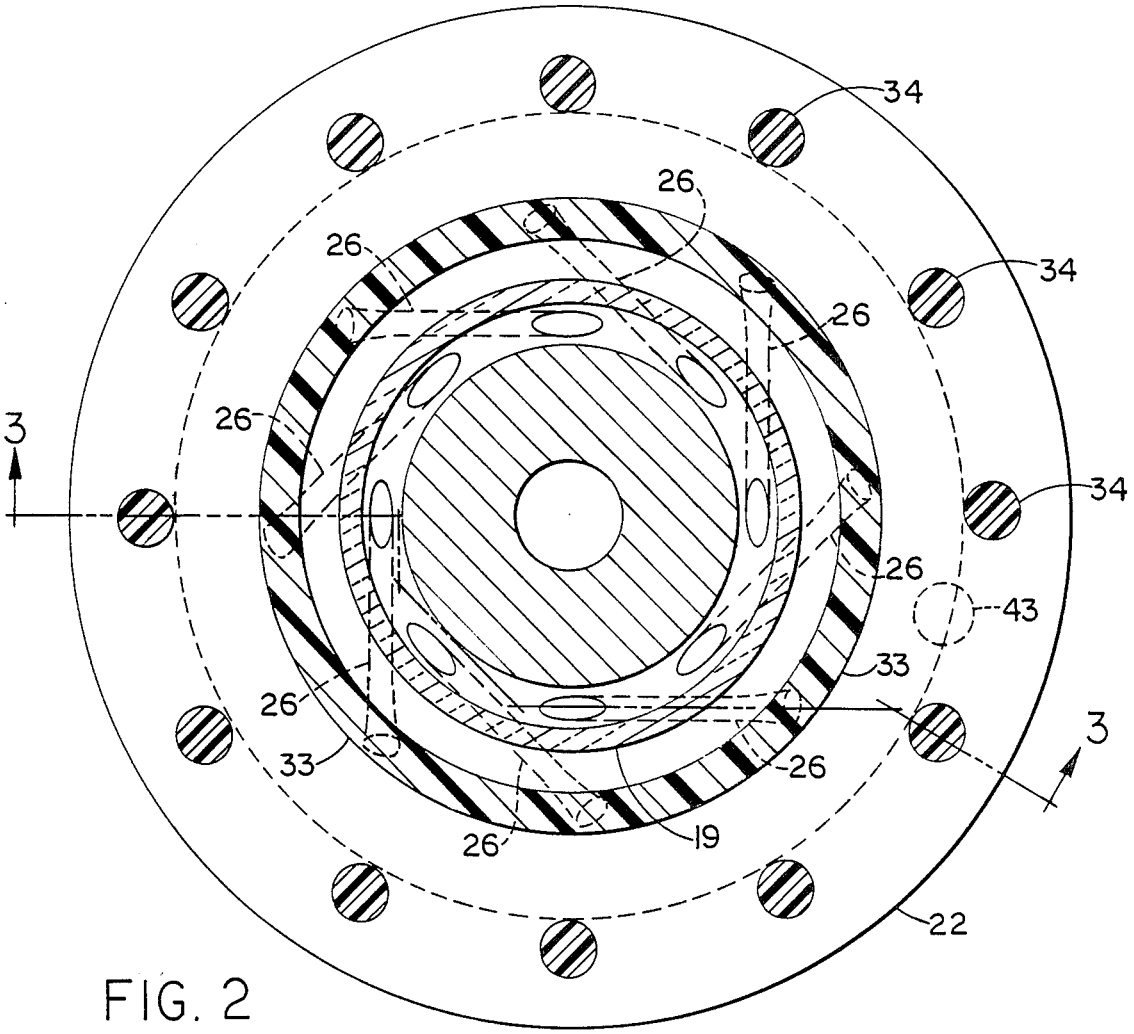
FIG. 2 is a cross sectional view taken along line 2—2 of FIG. 1 and showing the eight gas ejectors at the base of the electrode.
Figure 3:
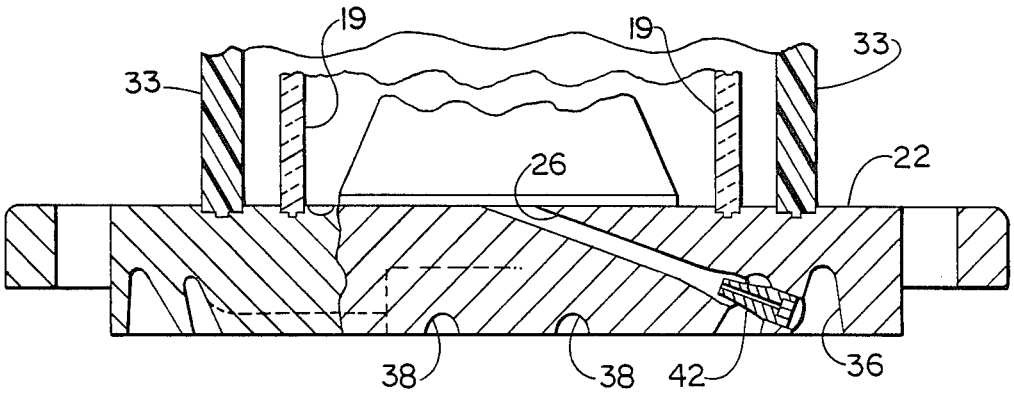
FIG. 3 is a cross sectional view taken along line 3—3 of FIG. 2 showing the placement of a jet pump in a gas ejector channel.

The geometric configuration of spark gap switch 10 is shown in FIGS. 1–3. Upper end electrode 12 and lower end electrode 14 are each spaced apart from trigger plane electrode 16. The three electrodes are held in position by cylindrical outer walls 18 and 19. It is to be noted that in the switch reduced to practice gap (a) between upper end electrode 12 and the trigger plane electrode 16 is smaller than gap (b). Ihe tip ends of both upper end electrode 12 and lower end electrode 14 have inserted therein replaceable electrode elements which in the system reduced to practice were formed of an infiltrated-copper/tungsten matrix material.

Upper end electrode 12 is supported by upper base plate 20. Lower end electrode 14 is supported by lower base plate 22. As best seen in FIGS. 2 and 3, there are a multiplicity of gas injection ports 26 penetrating lower base plate 22. The injection ports are drilled at an angle such that the axes are tangent with the inner wall at the base of the lower end electrode. In like fashion there are idential injection ports drilled in upper base plate 20. Gas injected into the region bounded by lower end electrode 14, base plate 22, cylindrical outer wall 19 and trigger plane electrode 16 flows along the outer wall of lower end electrode 14, swirls over the tip end of the truncated cone shaped electrode and exhausts out through discharge hole 28 in the center of lower end electrode 22. Gas flow around upper end electrode 12 is similarly derived with exhaust discharge out hole 30 in the center.

A second pair of pressure retaining cylindrical members 32 and 33 provides support for cylindrical outer walls 18 and 19. In the switch reduced to practice, cylindrical outer walls 18 and 19 were formed of alumina to withstand the X-ray and ultraviolet radiation generated by the switch closure. Cylindrical members 32 and 33 were formed of lucite. The entire switch assembly was structurally held together by twelve nylon rods 34. It is to be understood that rods 34 must be formed of an insulating material since the base plates of the end electrodes are electrically separated by hundreds of kilovolts prior to receipt of a trigger pulse between upper end electrode 12 and trigger plane electrode 16. Receipt of the trigger pulse breaks down the gas in gap (a) which then causes gap (b) to be overvolted leaving a conductive plasma between upper and lower end electrodes 12 and 14.

The gas flowing out of injection ports 26 comes from two sources. Referring to FIG. 4 there is shown a cross section of the bottom of base plate 22. An annulus 36 is milled in the bottom of base plate 22 is in communication via threaded orifice 42 in lower end cap 44 with a source of pressurized gas (see FIG. 1). Also, radiating outward from exhaust plenum 40, like the spokes of a wheel are exhaust gas recirculation passageways 38. There are as many exhaust gas recirculation passageways as there are gas injection ports 26.

Each exhaust gas recirculation passageway 38 terminates at a jet pump 42 which is driven by the pressurized source of fresh gas in annulus 36 (see FIGS. 3 and 5). The pumps consist of a mixing chamber 44 at the downstream terminus of each passageway 38. An air nozzle is secured so as to be in axial alignment with the channel of each injection port 26. The periphery of each air nozzle is sized so as to be threaded into the mixing chamber 44 formed by making a boring from the sidewall of annulus 36 in coaxial alignment with the axis of the channel of each injection port 26. The air nozzles can be properly positioned in each mixing chamber by an allen wrench insertable in the base of each air nozzle. The percentage of exhaust gas recirculated can be controlled in two ways. One way pertains to the pressure differential between incoming gas (see arrow 48, FIG. 1) and exhaust gas at the outlet in the end cap (see arrow 50, FIG. 1). The second way to control the amount of exhaust gas recirculated is to vary the size of the orifices in the jet pump air nozzles.

To limit the overall gas temperature rise when recirculated gas is entrained with fresh cool gas, the cooling fin arrangement shown in FIG. 6 is used. FIG. 6 shows a cross section of one of the recirculation passageways 38 that has been milled into lower base plate 22. Lower end cap 44 has a multiplicity of cooling fins formed in the exterior surface thereof. When blower cooled, these fins will dissipate much of the heat present in the exhaust gas.

It is to be understood that there is a similar complement of jet pumps incorporated in the gas flow system of the upper end electrode 12. If the magnitude of fresh gas flow for an operational spark gap switch is an amount P and the mass of the recirculated gas is an amount Q then the ratio of normal gas consumption to jet pump gas consumption is $$P/Q=1+a$$

where a is the jet pump gas entrainment ratio. Tests have shown that the entrainment ratio can be established at any desired value between 5 and 50. The switch pressure is selected for a given gas injection at the end of the exhaust lines by the size of the exhaust orifices or by the addition of a back pressure regulator. Changes in the flush factor through the active region of the switch must be adjusted externally by controlling the magnitude of the injection jet pressure.

The preferred embodiment has been described with reference to a spark gap switch having a trigger plane electrode. It is to be understood that the jet pump gas recirculation system is applicable to spark gap switches not having intervening plane electrodes. The same jet pump principal is also applicable to other types of switches (for example, rail gaps) which require flowing gases or liquids as dielectric hold-off media.

While there has been shown and described what is at present considered to be the preferred embodiment of the invention it will be obvious to those skilled in the art that various changes and modifications may be made therein without departing from the true scope of the invention as defined in the appended claims.

I claim:

1. Spark gap switch apparatus for completing an electrical circuit to pass current that rises in value very abruptly, said switch comprising:

housing means defining a chamber for receiving a pressurized gas, said housing having at least one gas inlet and at least one gas outlet;

upper and lower end electrodes spaced one from another within said chamber to form an interelectrode region therebetween, each of said electrodes having a base, an outer wall, a tip and a passage along its central axis coupled to said gas outlet, one of said end electrodes being adapted to be connected to a positive voltage source, the other end electrode being adapted to be connected to a negative voltage source;

trigger pulse means for breaking down the gas in the interelectrode region between said end electrodes to thereby provide a conductive plasma between said end electrodes;

gas injecting means coupled to said gas inlet for receiving and flowing a gas along the outerwall surface of both of said end electrodes, over the tips thereof, and out through said passages to carry away hot gas products as exhaust; and jet pump means associated with at least one of said end electrodes and communicating with said electrode's passage and its associated gas injecting means for entraining a portion of the hot exhaust gas with said incoming fresh gas at a location remote from said interelectrode region to recirculate said entrained exhaust gas.

2. The apparatus as defined in claim 1 wherein the trigger pulse means includes a trigger plane electrode mounted between said upper and lower end electrodes.

3. The apparatus as defined in claim 1 wherein each said electrode is configured as a truncated cone with its base having a larger diameter than its tip.

4. The apparatus as defined in claim 3 wherein said gas injecting means causes said gas to flow in a swirling motion as it travels along said electrode outerwalls.

5. The apparatus as defined in claim 1 wherein the jet pump means includes at least one jet pump, each of said jet pumps having a nozzle and a mixing chamber, said nozzles being in communication with said gas inlet.

6. The apparatus as defined in claim 5 wherein the gas inlet of said housing communicates with an annulus which in turn communicates with said nozzles of at least some of said jet pumps, and said mixing chambers are in communication with said passages along the central axis of said end electrodes to extract exhaust gas therefrom.

7. Apparatus as defined in claim 5 wherein a different portion of said jet pump means is associated with the base of each end electrode and a different annulus is in communication with the nozzles of each different portion of jet pumps.

* * * * *